US009054461B2

(12) United States Patent
Goto et al.

(10) Patent No.: US 9,054,461 B2
(45) Date of Patent: Jun. 9, 2015

(54) ELECTRONIC COMPONENT

(75) Inventors: Hiroki Goto, Kyoto (JP); Hideaki Kamata, Kyoto (JP); Shogo Takeda, Komae (JP); Takaki Tsutsui, Fuchu (JP); Tetsuya Kifune, Tokyo (JP)

(73) Assignee: NINTENDO CO., LTD., Kyoto (JP)

( * ) Notice: Subject to any disclaimer, the term of this patent is extended or adjusted under 35 U.S.C. 154(b) by 524 days.

(21) Appl. No.: 13/462,086

(22) Filed: May 2, 2012

(65) Prior Publication Data

US 2012/0282816 A1 Nov. 8, 2012

(30) Foreign Application Priority Data

May 6, 2011 (JP) ..... 2011-103390

(51) Int. Cl.
*H01R 13/6581* (2011.01)
*H01R 12/70* (2011.01)

(52) U.S. Cl.
CPC ..... *H01R 13/6581* (2013.01); *H01R 12/707* (2013.01)

(58) Field of Classification Search
CPC ..... H01R 13/65802; H01R 13/658; H01R 23/6873; H01R 23/7073
USPC ..... 439/607.36, 607.35, 607.4
See application file for complete search history.

(56) References Cited

U.S. PATENT DOCUMENTS

| | | | | |
|---|---|---|---|---|
| 5,928,035 | A * | 7/1999 | Jankowsky et al. | 439/607.36 |
| 6,379,184 | B1 * | 4/2002 | Bassler et al. | 439/607.27 |
| 6,450,835 | B1 * | 9/2002 | Lee | 439/607.4 |
| 6,623,301 | B2 * | 9/2003 | Lappoehn | 439/607.36 |
| 6,986,681 | B2 * | 1/2006 | Tsai | 439/607.36 |
| 6,994,591 | B2 * | 2/2006 | Huang | 439/607.36 |
| 8,337,248 | B1 * | 12/2012 | Lan et al. | 439/607.35 |
| 8,668,525 | B1 * | 3/2014 | Tu et al. | 439/607.36 |
| 2006/0063432 | A1 * | 3/2006 | Chen | 439/607 |

FOREIGN PATENT DOCUMENTS

| | | |
|---|---|---|
| JP | 2004-273338 A | 9/2004 |
| JP | 2009-212009 A | 9/2009 |

* cited by examiner

*Primary Examiner* — Gary Paumen
(74) *Attorney, Agent, or Firm* — Holtz, Holtz, Goodman & Chick PC

(57) ABSTRACT

An electronic component including a terminal holding unit which holds a plurality of terminals, a metallic shell which houses the terminal holding unit inside thereof, the metallic shell including an insulation opening where a connection object which connects with the terminals is inserted and contact terminals which are adjacent to the metallic shell, each of the contact terminals including a contact plane which faces an insertion direction of the connection object into the metallic shell. A plate-like leg for fixating the metallic shell to a substrate is formed at each of side surfaces of the metallic shell.

4 Claims, 14 Drawing Sheets

ELECTRONIC COMPONENT

BACKGROUND OF THE INVENTION

1. Field of the Invention

The present invention relates to an electronic component provided with an insertion opening and externally exposed type contact terminals.

2. Description of Related Art

As an electronic component which is provided with a metallic shell in which an insertion opening for a predetermined object is formed and which is to be attached to a substrate by soldering, a card connector, a connector for input/output of analog or digital signals, a connector for input/output of power and the like are included.

For example, a conventional card connector includes a housing for holding a plurality of terminals in a parallel manner and a metallic shell which forms an insertion, opening to insert a card by surrounding the housing with side surfaces and a top surface, and the conventional card connector is attached to a substrate by setting the plane sections at the tips of hanging plates, which extend outward in a state being hung down from the side surfaces of the metallic shell, as soldering surfaces (for example, see JP 2004-273338).

Here, in the card connector, degradation in peel strength due to residual stress is prevented by forming stiffness reduction means such as slits at positions more toward the base end side than the soldering surfaces of the hanging plates of the metallic shell in order to reduce the influence of thermal expansion due to soldering.

Further, in recent years, so-called mid-mount type electronic component where a notch that corresponds to the plane shape of the metallic shell is formed in a substrate and an electronic component is attached to the substrate in a state that the metallic shell is fit in the notch has become popular in response to a request to thin the substrate.

The mid-mount type electronic component includes a combined connector, which is a connector for analog/digital signals, provided with a terminal holding member to hold a plurality of signal terminals and a metallic shell which surrounds the terminal holding member and is soldered to a substrate by the tip plane surfaces of legs which extend from side surfaces of the metallic shell (for example, see JP 2009-212009).

Recently, there is developed a connector provided with externally exposed type contact terminals exposed outside of a casing, the contact terminals each having a contact plane which is vertical with respect to the insertion direction of the metallic shell and being adjacent to left and right sides of the metallic shell, so that electricity can be charged when an electronic device is set in a cradle. In such externally exposed type contact terminals, load can be transmitted easily in the same direction as the insertion direction of the metallic shell when the electronic device is set in the cradle and this can be a cause for peeling off of the metallic shell at the solder joint sections.

Therefore, although a great peel strength is required at the solder joint sections of the metallic shell, only the treatment for residual stress due to heating at the time of soldering is performed in the card connector of the patent document 1 and this treatment is not for reinforcing the peel strength itself at the solder joint sections.

Further, the combined connector of JP 2009-212009 can easily receive the load applied especially to the substrate in the vertical direction, that is, in the direction which can cause peeling at the soldering surfaces because it is a mid-mount type connector, and sufficient peel strength cannot be obtained just by soldering of the legs which extend from the metallic shell.

SUMMARY OF THE INVENTION

The main object of the present invention is to improve peel strength of an electronic component with respect to the substrate in an electronic component including an insertion opening and externally exposed type contact terminals.

According to a first aspect of the present invention, there is provided an electronic component including a terminal holding unit which holds a plurality of terminals, a metallic shell which houses the terminal holding unit inside thereof, the metallic shell including an insulation opening where a connection object which connects with the terminals is inserted and contact terminals which are adjacent to the metallic shell, each of the contact terminals including a contact plane which faces an insertion direction of the connection object into the metallic shell, and a plate-like leg for fixating the metallic shell to a substrate is formed at each of side surfaces of the metallic shell, the plate-like leg extends outward from each of the side surfaces of the metallic shell, and the plate-like leg includes an extended end section having a soldering surface shape including a base section that extends along an extending direction, an orthogonal extending section that extends from a side edge of the base section along the insertion direction of the insertion opening being orthogonal to the base section.

BRIEF DESCRIPTION OF THE DRAWINGS

The above and other objects, advantages and features of the present invention will become more fully understood from the detailed description given hereinbelow and the appended drawings, and thus are not intended as a definition of the limits of the present invention, and wherein.

DESCRIPTION OF THE PREFERRED EMBODIMENTS

Embodiment of the Invention

Overall Configuration

Figure 1:
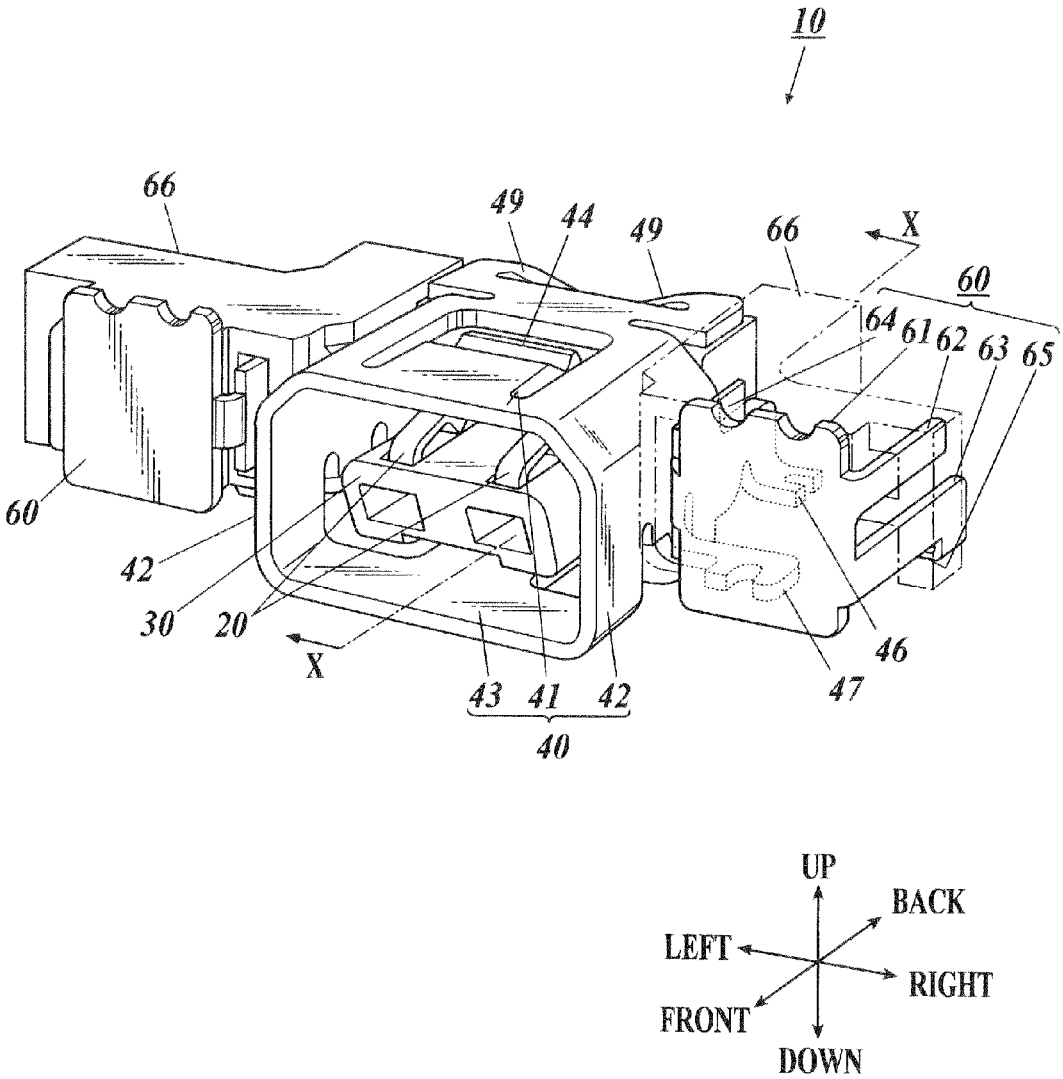
FIG. 1 is a schematic view of a connector according to an embodiment of the present invention.
Figure 2A:
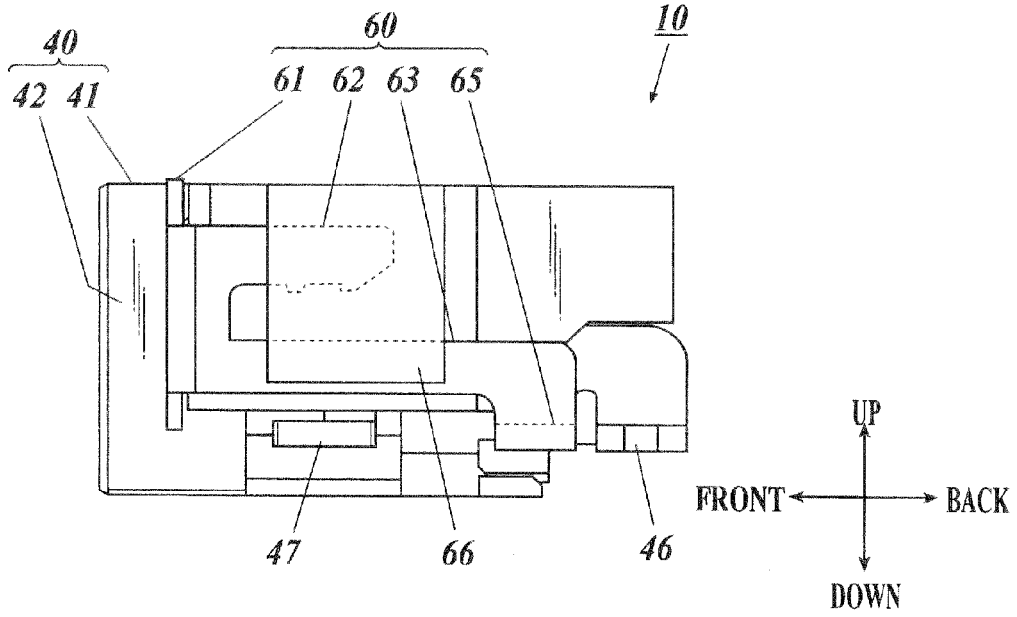
FIG. 2A is a side view of the connector.
Figure 2B:
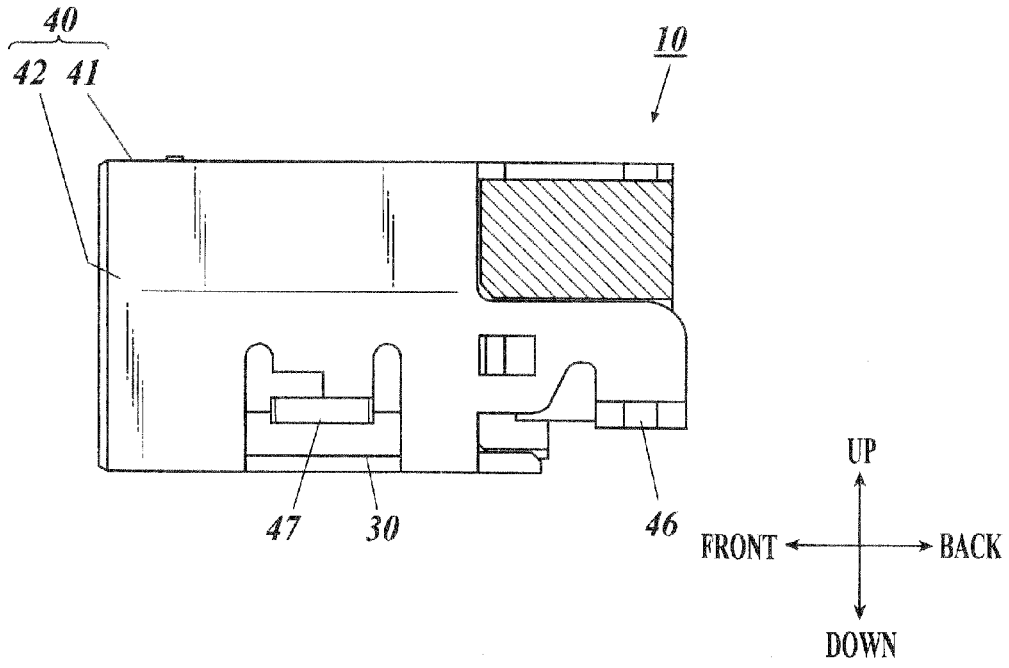
FIG. 2B is a side view of the connector in which a contact terminal and a contact terminal holding unit are omitted.
Figure 3:
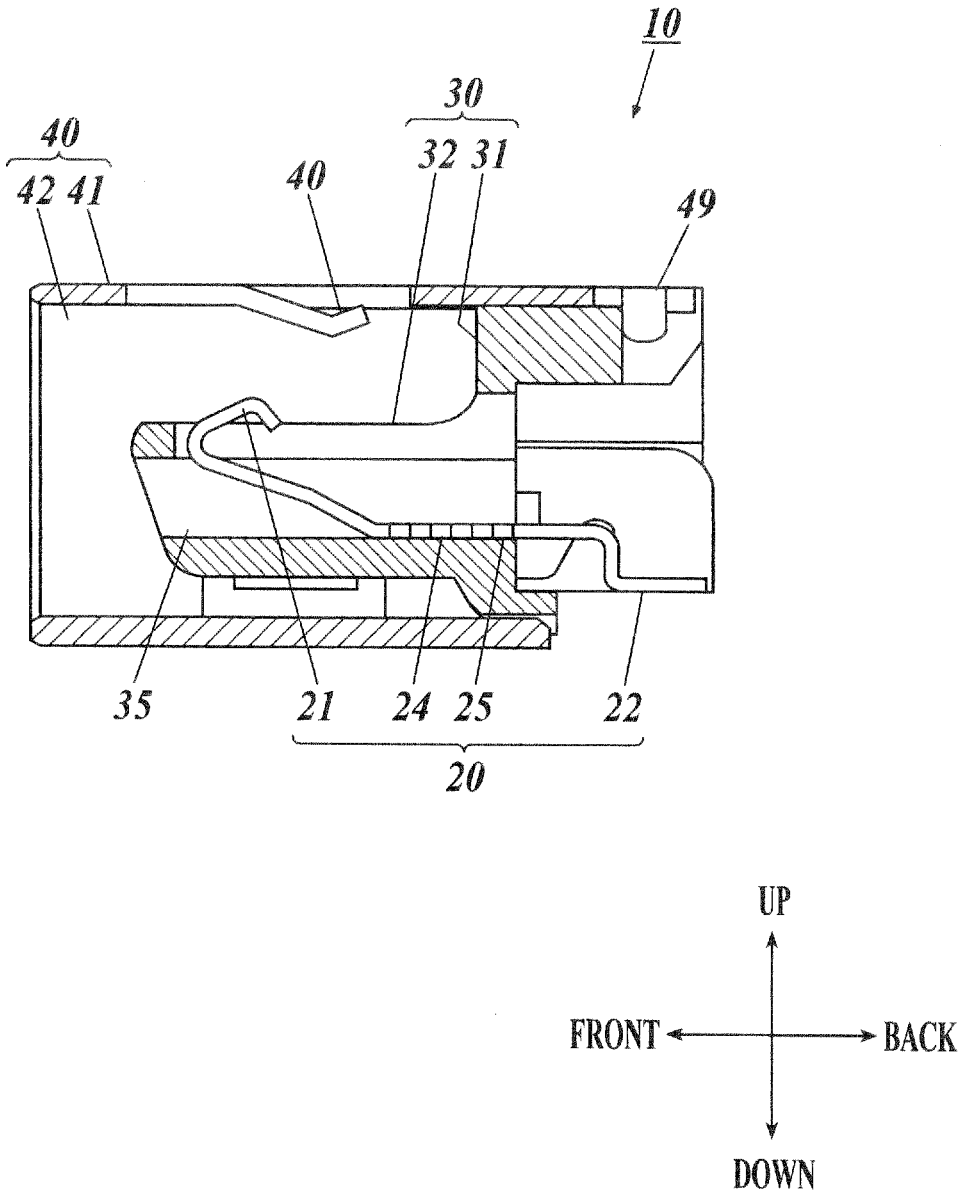
FIG. 3 is a cross-sectional view of the connector cut along the line X-X in FIG. 1.

The connector 10 as an electronic component of the embodiment of the present invention will be described based on FIGS. 1 to 6. FIG. 1 is a schematic view of the connector 10, FIG. 2A is a side view of the connector 10, FIG. 2B is a side view of the connector 10 in which the after-mentioned contact terminal 60 and contact terminal holding unit 66 are omitted and FIG. 3 is a cross-sectional view cut along the line XX in FIG. 1.

The connector 10 is a so-called mid-mount type connector which is to be equipped at an edge section of a substrate which is housed in a casing of an electronic product in a state being fitted in a notch. Further, this connector 10 is a so-called power receptacle connector and includes an insulation opening for a power plug connector, which is not shown, to be inserted.

This connector 10 includes a terminal holding unit 30 which holds two connecting terminals 20, 20 in a parallel manner, a metallic shell 40 which surrounds the four sides, which are above, below, right and left, of the terminal holding unit 30 and in which the insertion opening for the plug connector is formed, contact terminals 60, 60 which are provided adjacent to the metallic shell 40, each of which being provided with a contact plane 61 which is vertical with respect to the insertion direction of the plug connector into the metallic shell 40 and contact terminal holding units 66, 66 which respectively hold the contact terminals 60 and 60.

Hereinafter, descriptions will be given assuming that the insertion direction of the plug connector into the insertion opening of the metallic shell 40 of the connector 10 is the front-back direction, the aligning direction of the two connecting terminals 20, 20 is the right-left direction and the direction orthogonal to the front-back direction and the right-left direction is the up-down direction. Here, the front-back direction and the insertion direction of plug connector match each other and the down stream side in the insertion direction of plug connector is defined as "back" and the upper stream side in the insertion direction of plug connector is defined as "front".

[Connecting Terminal]

Each connecting terminal 20 is formed with a good conductor metal in a shape of flat bar, and the front end section of the connecting terminal 20 forms a spring contact point 21 by being folded upward. Further, the back end section of each connecting terminal 20 is formed in an approximate crank shape that warps downward, and the lower surface thereof is the contact point 22 that contacts the connecting terminal of the substrate and is soldered thereto.

Moreover, protrusions 24 and 25 are formed on both right and left sides of each connecting terminal 20, and the protrusions 24 and 25 fits to the concave portions, which are not shown in the drawing, formed in the after-mentioned slit 35 of the terminal holding unit 30 to fixate the connecting terminal 20 in the slit 35.

Further, one of the two connecting terminals 20 corresponds to the positive pole and the other corresponds to the negative pole.

[Terminal Holding Unit]

The terminal holding unit 30 is held inside the metallic shell 40. As shown in FIG. 3, a board 31 which is fixed to the metallic shell 40 is provided at the back end section of the terminal holding unit 30, and a projecting unit 32 which holds the connecting terminals 20 is provided so as to extend frontward from the board 31. The terminal holding unit 30 is formed of insulator such as insulating resin, for example.

When the terminal holding unit 30 is inserted in the metallic shell 40 from the back end side thereof as shown in FIG. 1, the front surface of the board 31 abuts the back end section of the metallic shell 40. At the position where the insertion is stopped by the board 31, the board 31 is fixated and held by the fixing claws 49 and 49, which are formed at the upper back end of the metallic shell 40, holding the back surface of the board 31.

The projecting unit 32 is in an approximate rectangle shape tapered at the front end therearound, and two slits 35, 35 are formed on the upper surface of the projecting unit 32 in a parallel manner along the front-back direction.

Each slit 35 penetrates to the back end surface of the board 31, and the contact point 22 of the connecting terminal 20 housed in the slit 35 is held in a state being protruded backward from the back end surface of the board 31.

The plug connector which is to be inserted inside the metallic shell 40 also has a cylindrical configuration smaller than the metallic shell 40 and includes two contact terminals facing downward at the upper part of the inner surface of the cylindrical configuration. When the plug connector is inserted into the metallic shell 40, the projecting unit 32 is to be inserted inside the cylindrical configuration of the plug connector and the two contact terminals of the plug connector respectively contact the spring contact points 21 of the connecting terminals 20, which project from the upper surface of the projecting unit 32, to establish an electrically connected state between each other.

[Contact Terminals and Contact Terminal Holding Units]

The contact terminals 60 and the contact terminal holding units 66 will be described based on FIGS. 1, 2A and 2B. Here, the contact terminals 60 and the contact terminal holding units 66 are provided respectively at right and left sides of the metallic shell 40, and their shapes in the right side and in the left side are different only in the aspect that the shapes are bilaterally symmetric. Therefore, descriptions will be given only for the contact terminal 60 and the contact terminal holding unit 66 in the right side.

Each part of the contact terminal 60 is formed by partially cutting out and bending a metallic plate having good conductivity.

A contact plane 61 formed in an approximate rectangular shape where the sides are parallel to each other in up-down direction and in right-left direction, first and second extending sections 62 and 63 which extend backward by being bent at right angle from the right side edge of the contact plane 61, a third extending section 64 which extend backward by being bent at right angle from the left side edge of the contact plane 61 and a plate-like leg 65 which extends inward (to the left) by being bent from the back end of the second extending section 63 are formed in the contact terminal 60.

In a state where the contact terminal 60 is held by the contact terminal holding unit 66, the contact plane 61 is disposed toward front side to the position near the front end section of the metallic shell 40. It is assumed that in a state where the substrate to which the connector 10 is mounted is disposed in the casing of an electronic device, the front surfaces of the contact planes 61 are to be disposed so as to be exposed from the openings formed in the wall of the casing to realize electrical connection via contact with an external contact terminal by pressurizing.

The first and the third extending sections 62 and 64 are both capable of fixating the contact terminal 60 to the contact terminal holding unit 66 by being inserted into the engaging holes formed in the front end surface of the contact terminal holding unit 66 from the front side.

The second extending section 63 positions below the first extending section 62 and the plate-like leg 65 is formed by extending downward from the back edge section of the second extending section 63 and further being bent inward (to the left) from the middle thereof.

The lower surface of the lower end section of the plate-like leg 65 is at approximately the same level as the upper surface of the substrate K when the connector 10 is mounted on the substrate K, and the lower surface is soldered to the substrate side terminal P4 (see FIGS. 4A and 4B) formed on the substrate K to establish an electrically connected state with each other. Here, the plate-like leg 65 can have a function to fixate the connector 10 to the substrate K by being soldered to the substrate side terminal P4. However, the main object of the plate-like leg 65 is to establish electrical connection for conductivity between the contact plane 61 and the substrate K.

The contact terminal holding unit 66 is formed integrally with the above-mentioned terminal holding unit 30, and the contact terminal holding unit 66 is connected by the side surface of the board 32 of the terminal holding unit 30.

The contact terminal holding unit 66 is extended forward while contacting the board 32 of the terminal holding unit 30 to the side surface section 42 of the metallic shell 40 along their sides, and the first and third extending sections 62 and 64 of the contact terminal 60 are inserted, respectively in the above-mentioned engaging holes in the front end surface of the contact terminal holding unit 66 to hold the contact terminal 60.

[Metallic Shell]

Each part of the metallic shell 40 is formed by partially cutting out, rolling and bending a metallic plate having good conductivity.

The metallic shell 40 is in a cylindrical shape where the cross-section thereof is approximately rectangle shape. The metallic shell 40 includes an upper surface section 41, left and right side surface sections 42 and 42 and a bottom surface section 43 and houses approximately the entire terminal holding unit 30 and the connecting terminals 20.

At the center of the upper surface section 41 of the metallic shell 40, a tongue-like plate spring 44 is formed by notching out an approximately U-shape. The tip section of the tongue-like plate spring 44 is warped downward and can be pressed to contact the plug connector inserted in the metallic shell 40 so that the plug connector will not be pulled out easily.

On the right side surface section 42 of the metallic shell 40, two plate-like legs 46 and 47 that extend outward (further to the right side) are formed by being bent from the side surface section 42 so as to stand in the right-left direction. The plate-like leg 46 which is one of the plate-like legs is positioned at the back end of the side surface section 42 of the metallic shell 40 (hereinafter, the plate-like leg 46 is called "back side plate-like leg" for differentiation). The plate-like leg 47 which is the other of the plate-like legs is positioned at approximate center of the side surface section 42 in the front-back direction (hereinafter, the plate-like leg 47 is called "front side plate-like leg" for differentiation).

Similarly, the front side and back side plate-like legs 46 and 47 extending outward (further to the left side) are formed on the left side surface section 42, and they have the same configurations as the plate-like legs on the right side surface section 42 except that the extending direction is the opposite. Therefore, descriptions will be given mainly for the front side and back side plate-like legs 46 and 47 of the right side surface section 42.

Figure 4A:
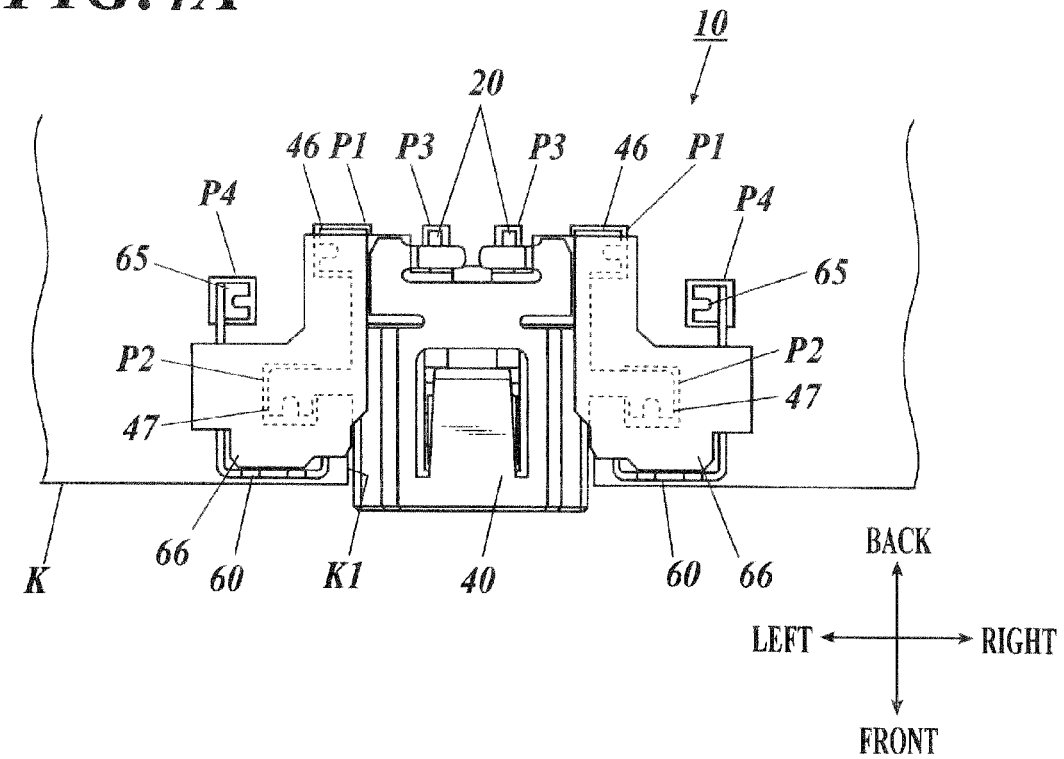
FIG. 4A is a plane view when the connector is mounted on a substrate.
Figure 4B:
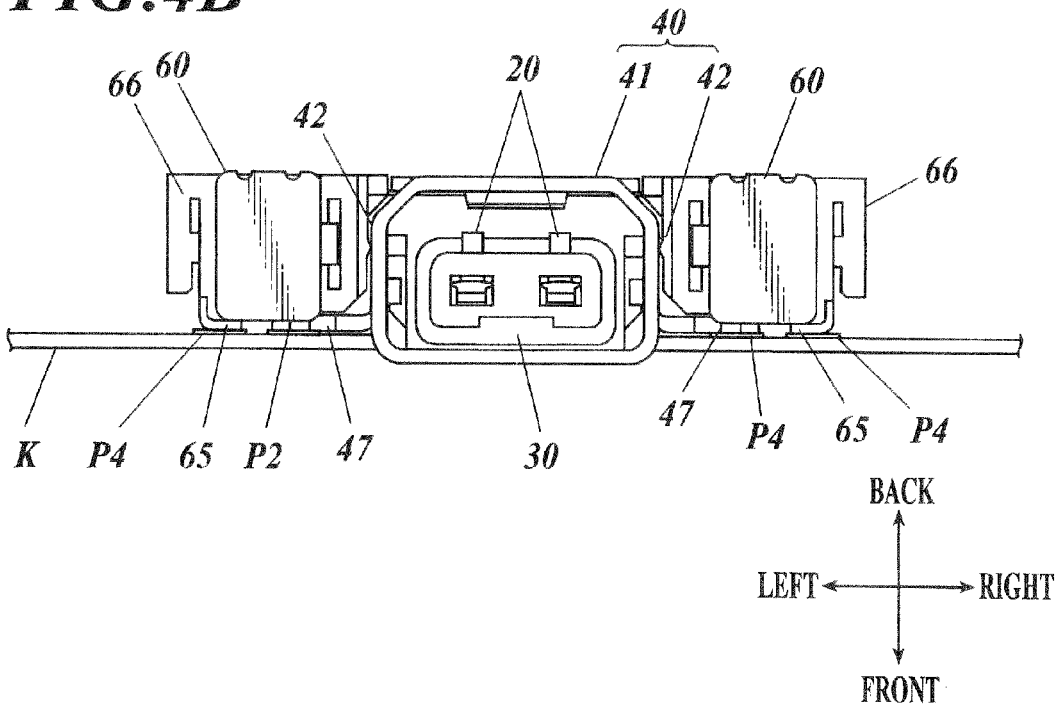
FIG. 4B is a front view when the connector is mounted on the substrate.

FIG. 4A is a plane view when the connector 10 is mounted on the substrate K and FIG. 4B is a front view when the connector 10 is mounted on the substrate K.

The connector 10 is mounted so as to engage with the notch K1, the notch K1 being notched out in a shape corresponding to the plane shape of the metallic shell 40 at the edge section of the substrate K. At that time, the connector 10 is mounted so that the level of the bottom surface section 43 of the metallic shell 40 is to be lower than the level of the lower surface of the substrate K, that is, a so-called mid-mount method is applied here. That is to say, the connector 10 is provided so as to be under the substrate K comparing to the case where the connector 10 is mounted in a state being set on the upper surface of the substrate K. In such way, the connector 10 does not project from the substrate K after being mounted and the substrate K after components are mounted can be thin.

With respect to both of the front and back plate-like legs 46 and 47 provided at the side surface section 42 of the metallic shell 40, the lower surfaces thereof are positioned higher than the bottom surface section 43 of the metallic shell 40, and at the time of mounting by the mid-mount method, mounting is performed so that the lower surfaces of the tip sections of the front and back plate-like legs 46 and 47 are at approximately the same level as the upper surface of the substrate K. In such way, the upper surface section 41 of the metallic shell 40 is to be higher than the upper surface of the substrate K and the bottom surface section 43 of the metallic shell 40 is to be lower than the lower surface of the substrate K.

Moreover, the front and back plate-like legs 46 and 47 are soldered respectively to the substrate side terminals P1 and P2 which are formed on the upper surface of the substrate K. Here, the substrate side terminals P1 and P2 are SMT (Surface Mount Technology) terminals.

At this time, either one of the substrate side terminal P1 and the substrate side terminal P2 or both of them are connected to the earth to be used as a terminal for earth connection of the metallic shell 40.

In the connector 10, the plate-like legs 46 and 47 are provided at each of the left and right side surfaces of the metallic shell 40 at the back end thereof and at a position forward than the back end, respectively, and the plate-like legs 46 and 47 are soldered to the substrate K. Here, as shown in FIG. 4A, the contact point 22 of each of the connecting terminals 20 is also soldered to each of the connecting terminals P3 of the substrate K. However, these soldering are mainly for electrical connection for energization, and the attachment strength of the connector 10 to the substrate K is mainly assumed by the bonding strength between the left and right plate-like legs 46 and 47 and the respective substrate-side terminals P1 and P2.

The connector 10 is provided with contact terminals 60 respectively in the left side and the right side of the metallic shell 40, wherein an external terminal is brought into contact with the contact planes 61 of the contact terminals 60 from the front side by pressurizing. Therefore, at the time when an external terminal contacts the contact terminals 60 of the connecter 10 by pressurizing, load is applied by assuming that the back end side of the metallic shell 40 is the supporting point, the front end side of the metallic shell 40 is the point of effort and the front side plate-like legs 47 positioned in middle is the point of action. Thus, greater peel load is received by the front side plate-like legs 47 than the back side plate-like legs 46, and there is a need to reinforce the front side plate-like legs 47 with respect to the peel load.

The back side plate-like leg 46 extends downward in a vertical direction from the base end section thereof in the right side surface section 42 side and is bent in a horizontal direction in the middle thereof to extend toward right direction. The back side plate-like leg 46 of the left side surface section 42 extends toward left direction.

Further, in the back side plate-like leg 46, the width thereof in front-back direction is uniform from its base end section to tip section and the soldering surface of the plate-like leg 46 that contacts the substrate side terminal P1 is in a approximately rectangle shape. As described above, because smaller peel load is applied to the back side plate-like leg 46 comparing to the front side plate-like leg, durability can be assured even when the shape of the soldering surface is a simple shape with small working man-hours.

Figure 5:
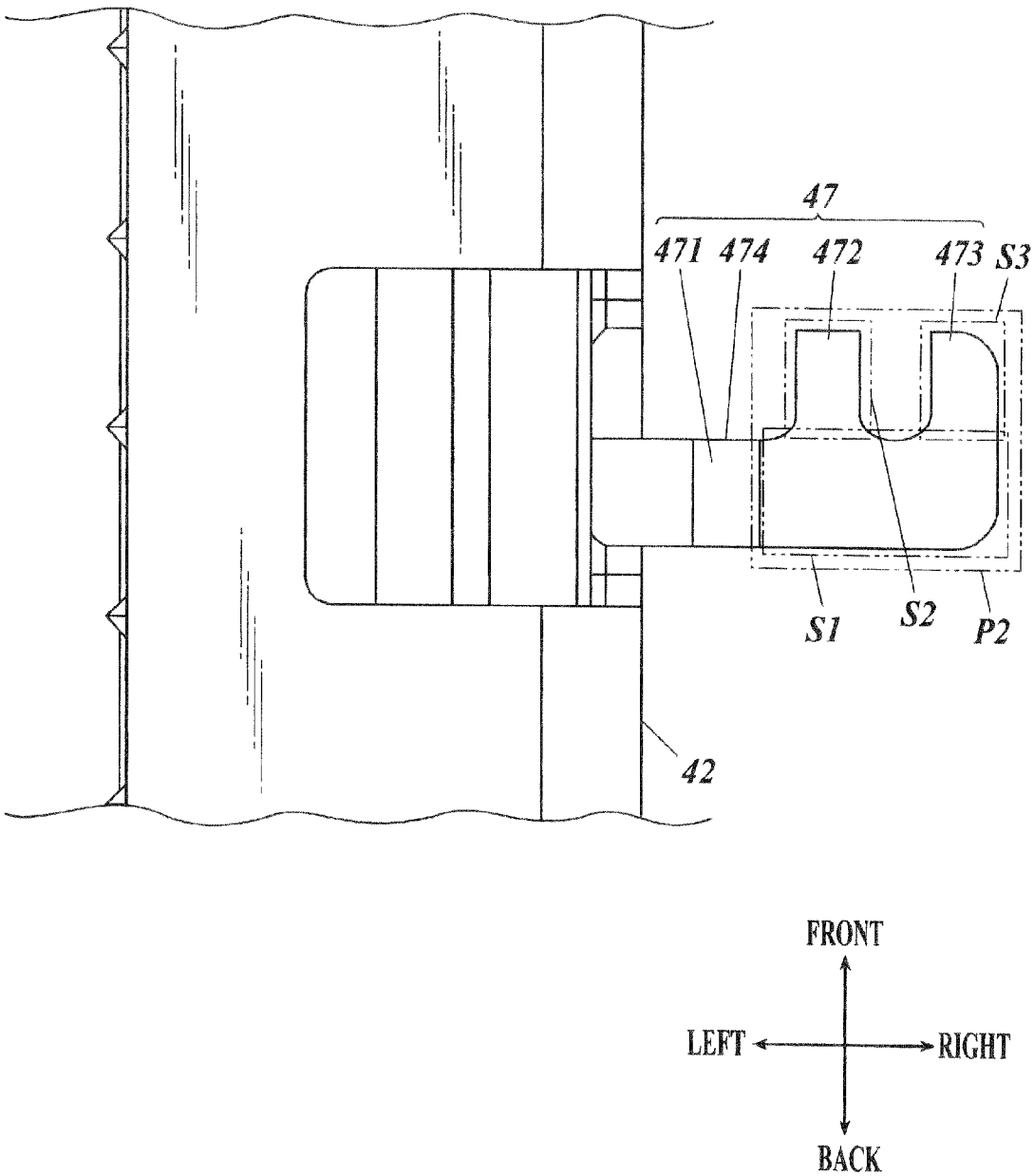
FIG. 5 is an enlarged bottom view when a front side plate-like leg of the connector is seen from below.

Next, a front side plate-like leg 47 will be described. FIG. 5 is an enlarged bottom view when the front side plate-like leg 47 is seen from below. In FIG. 5, the substrate side terminal P2 is shown in dashed-two dotted lines. In the lower surface of the front side plate-like leg 47, the range encircled in the substrate side terminal P2 is the soldering surface.

The front side plate-like leg 47 includes a first extending section 471 having a constant width in front-back direction from the base end section in the right side surface section 42 side to the tip section in the extending direction and a second extending section 472 and a third extending section 473 which extend frontward (toward upstream side in the insertion direction of the plug connector) from the front side end section 474 of the first extending section 471 by being orthogonal to the first extending section 471 within the range of the substrate side terminal P2.

That is, the soldering surface of the front side plate-like leg 47 is in a shape that includes the base section S1 extending to the right side having a constant width in front-back direction and the two orthogonal extending sections S2 and S3 extending frontward (toward the upstream side in the insertion direction of the plug connector) from the front side end section of the base section S1 by being orthogonal to the base section S1, the base section S1 being the same shape as the lower surface of the first extending section 471 and the two orthogonal extending sections S2 and S3 being the same shape as the lower surfaces of the second and third extending sections 472 and 473, respectively.

Moreover, the front side plate-like leg 47 which is provided at the left side surface section 42 has the same configuration as the above described plate-like leg 47 except for the aspect that the first extending section 471 and the base section S1 extend to the left side.

[Structural Effect of Front Side Plate-Like Legs]

Figure 6A:
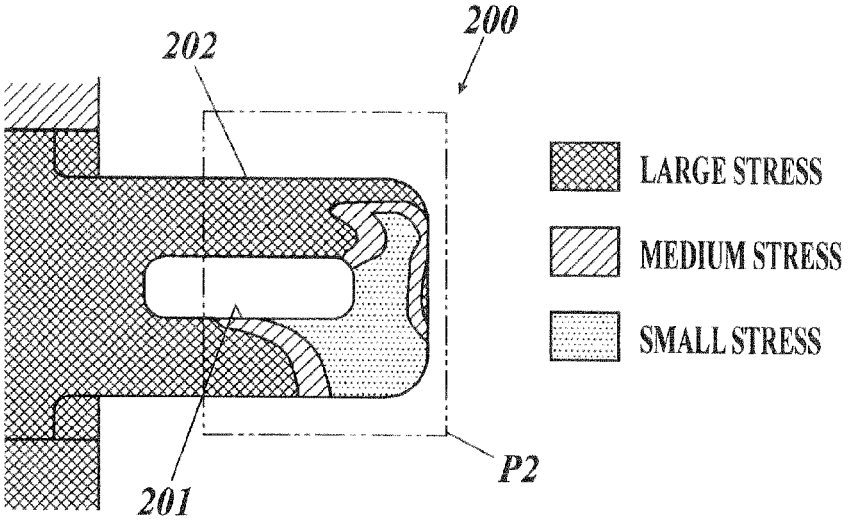
FIG. 6A is an explanatory diagram showing a stress distribution in a plate-like leg when an upward load is applied to the front end side of a metallic shell and shows a stress distribution in a comparison example.
Figure 6B:
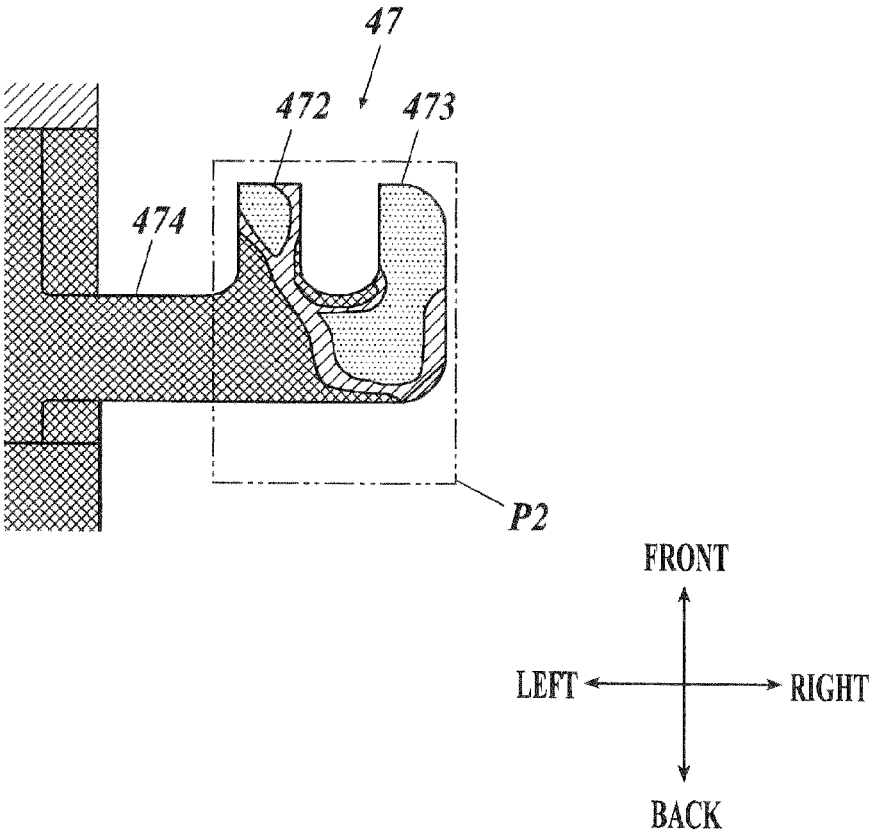
FIG. 6B is an explanatory diagram showing a stress distribution in a plate-like leg when an upward load is applied to the front end side of a metallic shell and shows a stress distribution in a plate-like leg of the embodiment.

Next, advantage in improvement of peel strength in the plate-like legs 47 having the above configuration will be described with reference to the comparison with a comparison example. When the comparison example metallic shell 40 which includes plate-like legs 200 having a configuration different from the front side plate-like legs of the metallic shell 40 and the metallic shell 40 which includes the above described plate-like legs 47 are soldered to substrates by the front and back plate-like legs and when an upward load is applied to the front end side of each of the metallic shells 40, the stress distributions in the plate-like legs are shown in FIGS. 6A and 6B. The stress distribution in a plate-like legs 200 of the comparison example is shown in FIG. 6A and the stress distribution in a plate-like legs 47 is shown in FIG. 6B.

In each plate-like leg 200 of the comparison example, the width in front-back direction from the base end section to the tip section is constant and an elongated hole 201 that penetrates from front to back is formed at the middle in front-back direction. When soldering is to be performed, greater peel strength can be obtained when the outline of the soldering surface is longer because solder is applied from the outer edges up to the side surfaces of the soldering surface. In the plate-like leg 200 of the comparison example, outline length which is about the same as that in the plate-like leg 47 can be obtained by forming the elongated hole 201, and thereby attempts to uniformize the comparison condition.

As described above, when an upward load is applied from the front side, the peel load is to be transmitted in the right direction from the side surface section 42 along the edge section in the front side of the plate-like leg in all of the plate-like legs. In the case of the plate-like leg 200 of the comparison example, it is shown in FIG. 6A that large stress is generated all the way to the position closer to the tip section because the edge part 202 in the front side is a straight line from the base end section to the tip section.

On the other hand, in the plate-like leg 47, the peel load is transmitted toward the right direction from the base send section long the edge section 474 in the front side. However, because the second extending section 472 which extends frontward is formed in the middle of the edge section 474, transmission of the peel load is blocked. Further, because the stress is applied from the front end section of the metallic shell 40, transmission of the stress in front direction is blocked although the stress is transmitted easily in back direction. Therefore, transmission of the peel stress in front direction along the edge section 474 in the front side to the second extending section 472 is also blocked. Thus, in the case of the plate-like leg 47, FIG. 6B shows that large stress only ranges to the position more distant from the tip section.

In such way, because the soldering surface of the front side plate-like leg 47 is in a shape including the base section S1 that extends along the extending direction of the plate-like leg 47 and the orthogonal extending sections S2 and S3 that extend frontward by being orthogonal to the base section S1, the metallic shell 40 can effectively suppress the load generated due to an external terminal brought into contact with the contact planes 61 of the contact terminals 60 by pressurizing, especially the transmission of stress due to the upward load that acts to cause peeling. Thereby, even when external terminals are brought into contact with the contact terminals 60 by pressurizing, the plate-like legs 47 can be prevented from peeling for a long period of time or for a great number of times of contacting and a great endurance can be obtained.

Moreover, because each of the plate-like legs 47 includes a plurality of (in this example, two) orthogonal extending sections S2 and S3 corresponding to the extending sections 472 and 473 along the extending direction of the plate-like leg 47, the peel stress that transmits passing through the orthogonal extending section S2 can be further reduced by the subsequent orthogonal extending section S3, and the peel stress to be transmitted can be reduced gradually. Because a plurality of orthogonal extending sections S2 and S3 are lined, the subsequent orthogonal extending section can prevent the peeling even when peeling occurs at the first orthogonal extending section. Thus, the plate-like leg 47 can be prevented from peeling for a long period of time and for a great number of times of contacting and the endurance can be improved even more.

Further, soldered conditions of a plate-like leg 47 and a plate-like leg 200 are shown in FIGS. 7A and 7B and FIGS. 8A and 8B. Because a concave shape notch is formed between the second extending section 472 and the third extending section 473 in the plate-like leg 47 and an elongated hole 201 is formed in the plate-like leg 200, in both cases, the outline of soldering surface can be assured to be longer and peel strength thereof can be improved in both cases.

Figure 7A:
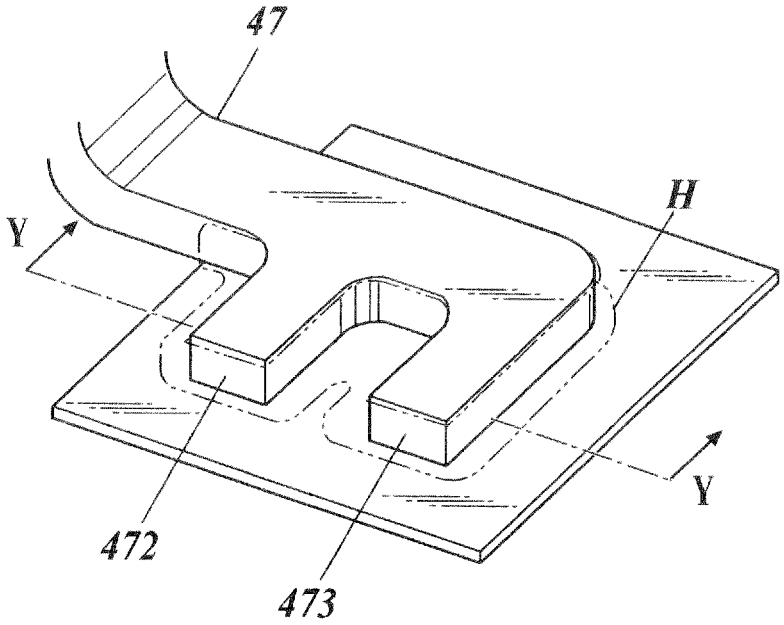
FIG. 7A is a schematic view showing a state where a plate-like leg of the embodiment of the present invention is soldered.
Figure 7B:
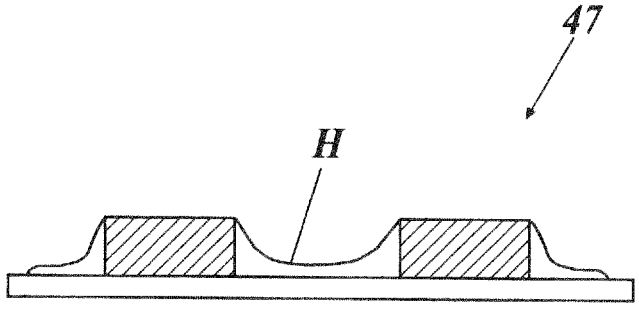
FIG. 7B is a cross-sectional diagram when cut along the line Y-Y in FIG. 7A.

However, due to the concave shape section in the plate-like leg 47 having a shape where its opening is opened toward one direction, solder H runs into inside of the concave shape section and adheres up to the upper part of the side surfaces, not only on the soldering surface, as shown in FIG. 7B. Therefore, peel strength can be improved even more effectively.

Figure 8A:
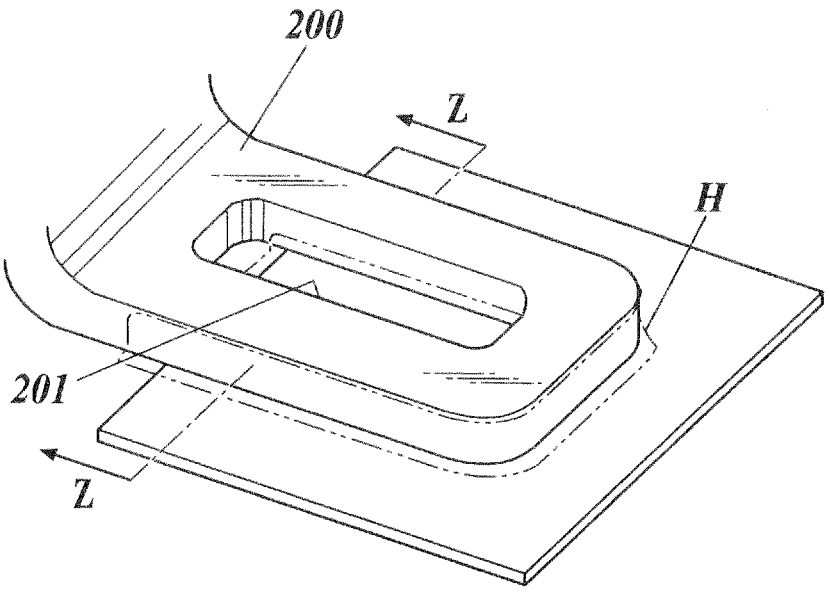
FIG. 8A is a schematic view showing a state where a plate-like leg of comparison example is soldered.
Figure 8B:
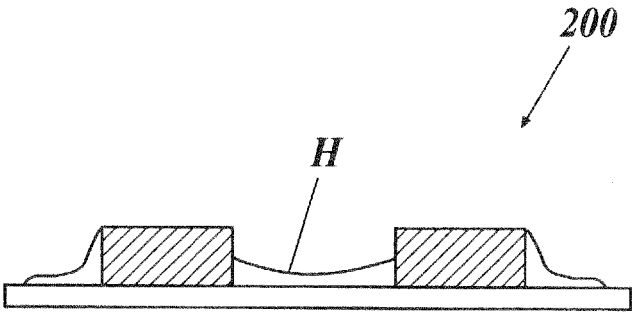
FIG. 8B is a cross-sectional view when cut along the line Z-Z in FIG. 8A.

On the other hand, because the elongated hole 201 is a closed area in the case of the plate-like leg 200, solder H does not run into the elongated hole 201 area, and the solder H does not adhere up to the upper part of the side surfaces of the elongated hole 201 as shown in FIG. 8B. In such aspect, this is a configuration which can cause degradation in peel strength.

[Examples of Other Shapes for Plate-Like Leg]

Other examples of shape of the plate-like leg in which a structure durable to peel load is realized will be described below. In the description hereinbelow, the plane shape of the plate-like leg will be described, and it is assumed that the plane shape and the shape of the soldering surface match each other.

Figure 9A:
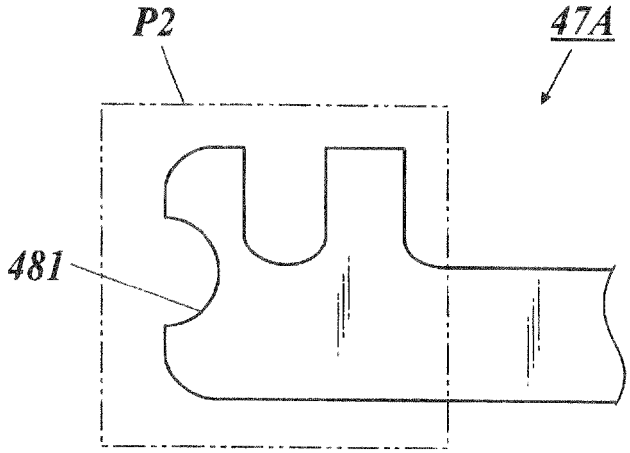
FIG. 9A is a plane view of another example of plate-like leg and is an example where a concave shape section is added at the side end.
Figure 9B:
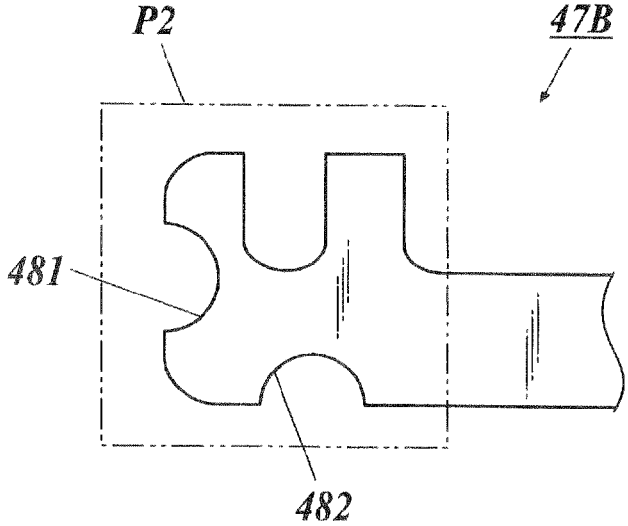
FIG. 9B is a plane view of another example of plate-like leg and is an example where concave shape sections are added respectively at the side end and the back end.

As shown in the plate-like legs 47A and 47B in FIGS. 9A and 9B, the plate-like legs may be in a shape similar to the above described plate-like leg 47 and further including concave shape sections 481 and 482 at end sections, for example, at the side end and/or the back end. By having such concave shape sections, the outline length is to be extended and the peel strength is to be reinforced.

Figure 9C:
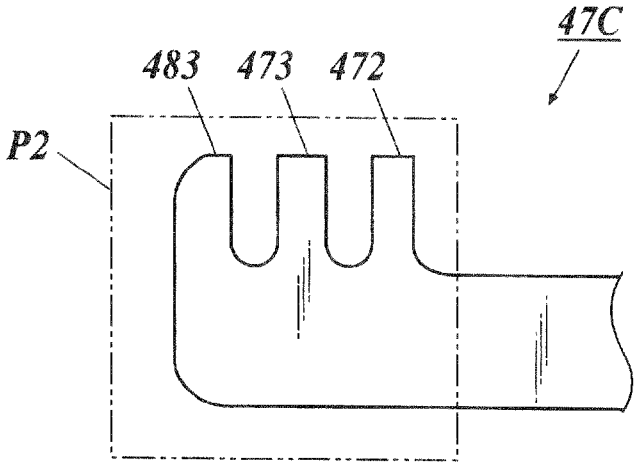
FIG. 9C is a plane view of another example of plate-like leg and is an example where one extending section that extends frontward is further added.

Moreover, as shown in the plate-like leg 47C in FIG. 9C, the plate-like legs may be in a shape having the second and third extending sections 472 and 473 extended frontward similarly to the above described plate-like leg 47 and further having the fourth extending section 483. In such way, durability with respect to peel strength can be enhanced even more.

Figure 10A:
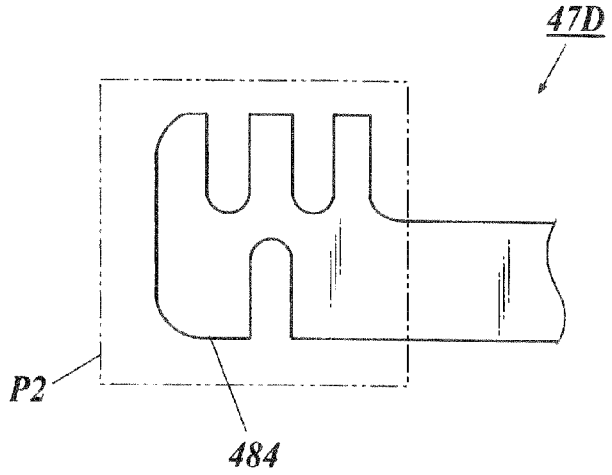
FIG. 10A is a plane view of another example of plate-like leg and is an example where one extending section that extends backward is added.
Figure 10B:
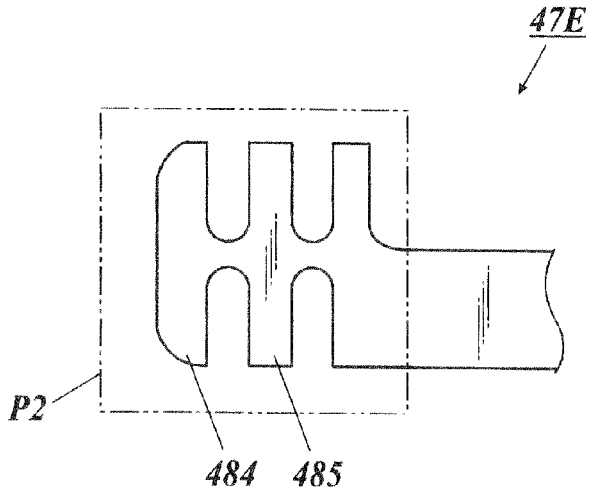
FIG. 10B is a plane view of another example of plate-like leg and is an example where two extending sections that extend backward are added.

As shown in the plate-like legs 47D and 47E in FIGS. 10A and 10B, the plate-like legs may be in a shape similar to the above described plate-like leg 47 and further having the fifth and sixth extending sections 484 and 485 which extend backward at the back end.

The extended sections which are orthogonal to the extending direction (right-left direction) of the plate-like leg can effectively block transmission of the peel load received at the front end section of the metallic shell 40 when the extending sections are extended frontward. However, even in the case of the fifth and sixth extending sections 484 and 485 that extend backward, transmission of the peel load can be blocked as long as the extending sections are in the direction orthogonal to the extending direction of the plate-like leg.

In the above described plate-like leg 47, the first extending section 471 may have a wider width in front-back direction for the portion between the base end section to the second extending section 472. That is, as shown in the plate-like legs 47F, 47G and 47H in FIGS. 11A to 11C, the first extending section 471 may have a shape where the width is wide in front-back direction from the base end section to the position just before the second extending section 472 and the width is narrowed in front-back direction due to the concave shape section at the position just before the second extending section 472 and then, the second extending section 472 is extended frontward. In such case, similar effect as in the case of the above described plate-like leg 47 can also be obtained.

Moreover, as shown in the plate-like legs 47G and 47H, the plate-like legs may be in a shape where concave shape sections 481 and 482 are added at the side end or the back end.

Figure 11A:
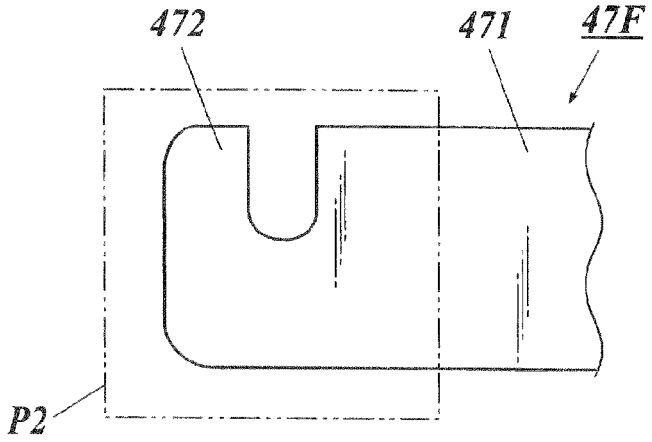
FIG. 11A is a plane view of another example of plate-like leg and is an example where the width in front-back direction of the first extending section is wide.
Figure 11B:
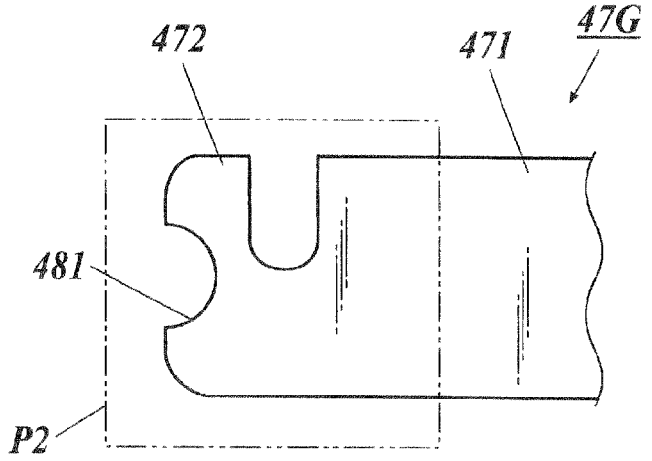
FIG. 11B is a plane view of another example of plate-like leg and is an example where a concave shape section is further added at the side end.
Figure 11C:
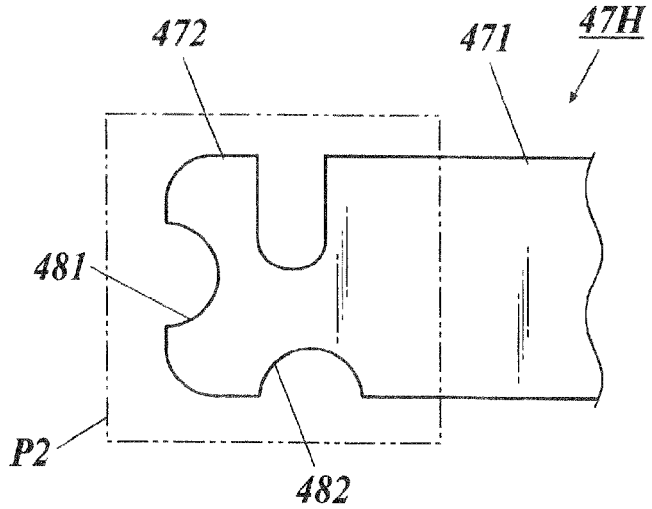
FIG. 11C is a plane view of another example of plate-like leg and is an example where concave shape sections are added respectively at the side end and the back end.
Figure 12:
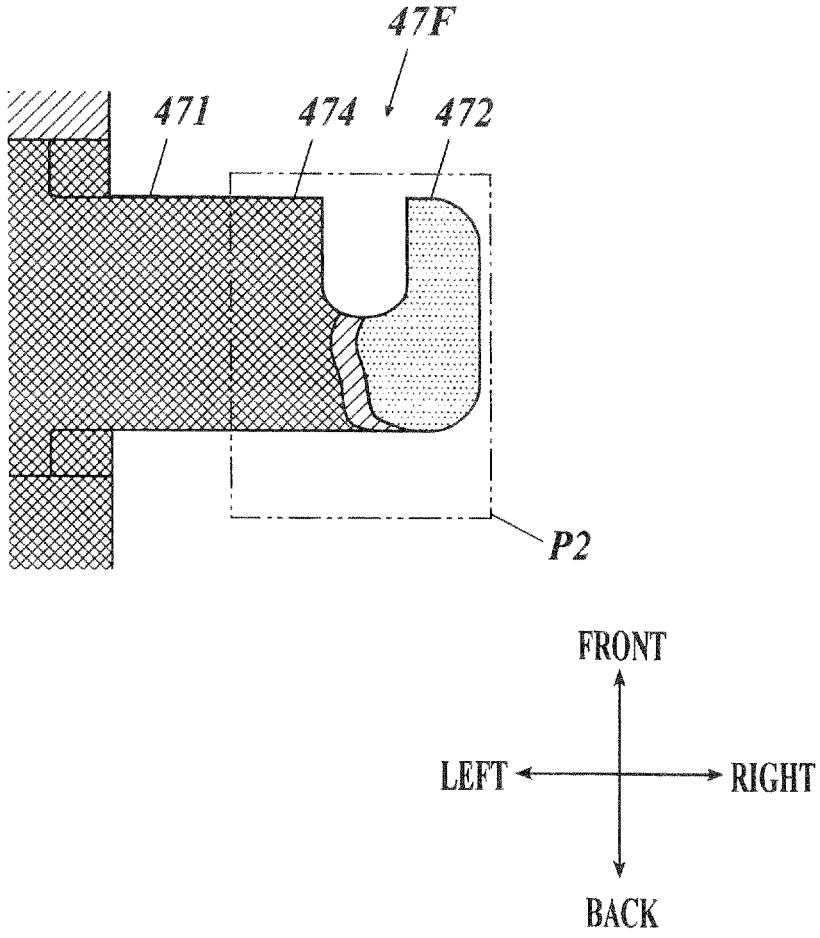
FIG. 12 is an explanatory diagram showing a stress distribution in the plate-like leg of FIG. 11A when an upward load is applied to the front end side of the metallic shell.

FIG. 12 is a diagram showing the stress distribution in the plate-like leg 47F when the plate-like leg 47F of FIG. 11A is fixated to the substrate by soldering and an upward load is applied to the front end of the metallic shell 40.

In the plate-like leg 47F, the peel load is transmitted toward right direction along the based end section thereof to the edge section 474 in the front side. However, the plate-like leg 47F has a shape where the first extending section 471 is wide in its width in front-back direction from the base send section to the position just before the second extending section 472 and the width in front-back direction is narrowed due to a concave shape section at the position just before the second extending section 472 and then, the second extending section 472 is extended frontward. Therefore, FIG. 12 shows that the peel load is blocked from being transmitted to the second extending section 472 which positions further than the concave shape section.

Figure 13A:
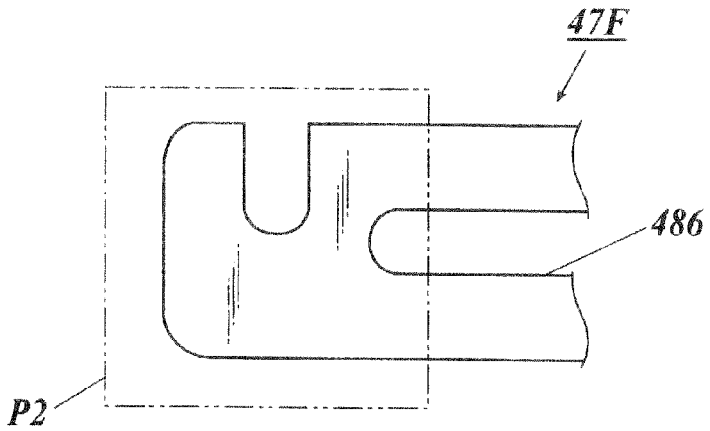
FIG. 13A is a plane view of another example of plate-like leg and is an example where the width in front-back direction of the first extending section is wide and an elongated hole is formed.
Figure 13B:
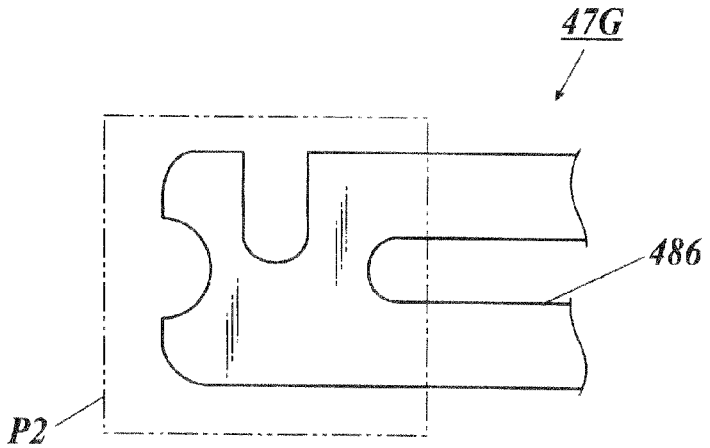
FIG. 13B is a plane view of another example of plate-like leg and is an example where a concave shape section is further added at the side end.
Figure 13C:
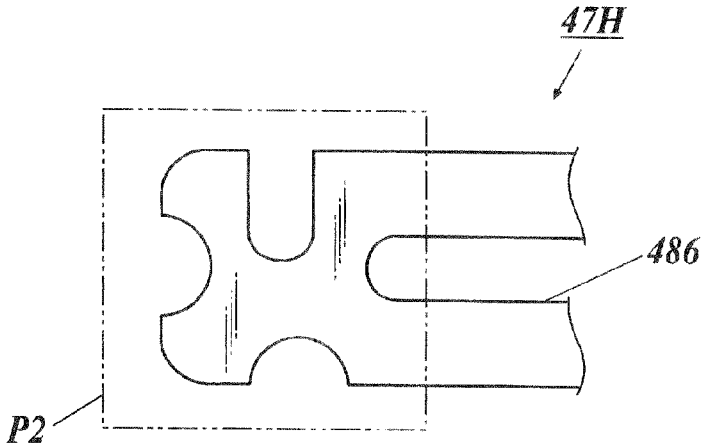
FIG. 13C is a plane view of another example of plate-like leg and is an example where concave shape sections are added respectively at the side end and the back end.

Further, as shown in the plate-like legs 47F, 47G and 47H, when the first extending section 471 has wide width, an elongated hole 486 may be formed along left-right direction at the center in front-back direction as shown in FIGS. 13A to 13C.

When deflection in front-back direction or the like occurs between each of the soldering surfaces of the plate-like leg 47F, 47G and 47H and the metallic shell 40 due to thermal expansion or the like, the elongated hole 486 can make the first extending section 471 deflect easily to prevent the peel strength generated by the residual stress from being degraded.

With respect to the durability structure with respect to peel load in the plate-like leg, only the examples where the shape of soldering surface and the shape of plate-like leg when seen planarly match each other are shown in the above described examples for the plate-like leg. However, matching of the shape of soldering surface and the shape of plate-like leg when seen planarly is not a required condition.

That is, in the above described plate-like leg 47, the second and third extending sections 472 and 473 are formed by cutting out the portion between the second extending section 472 and the third extending section 473 in a concave shape to form the orthogonal extending sections S2 and S3 in the soldering surface.

Figure 14A:
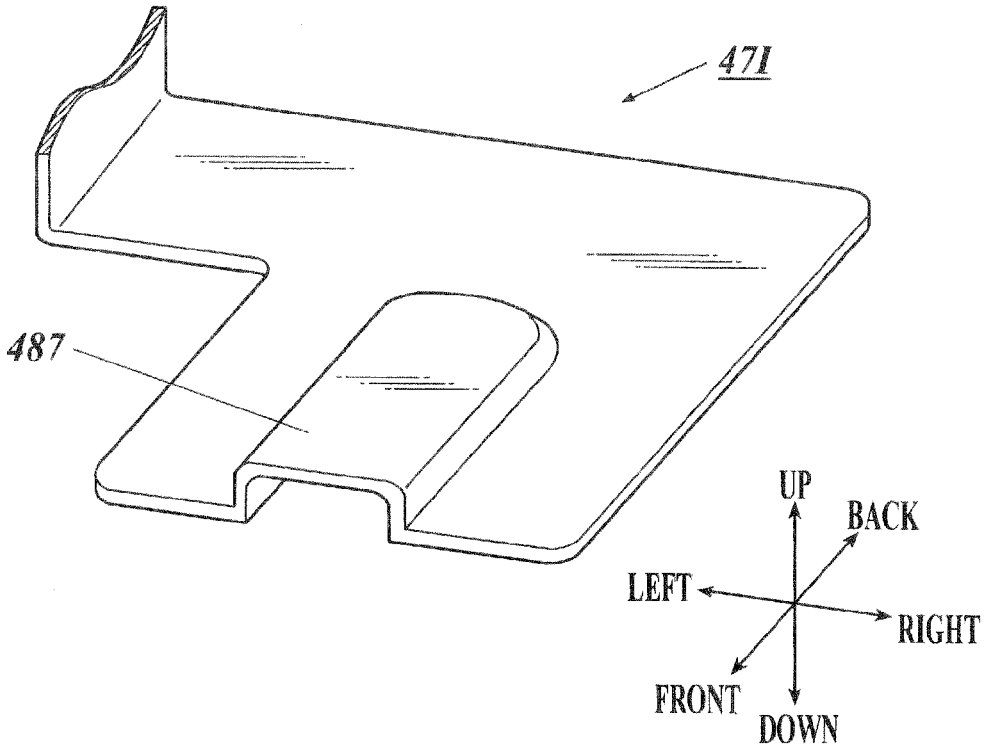
FIG. 14A is a schematic view showing an example where an indentation in a concave shape is formed, which is another example of plate-like leg.
Figure 14B:
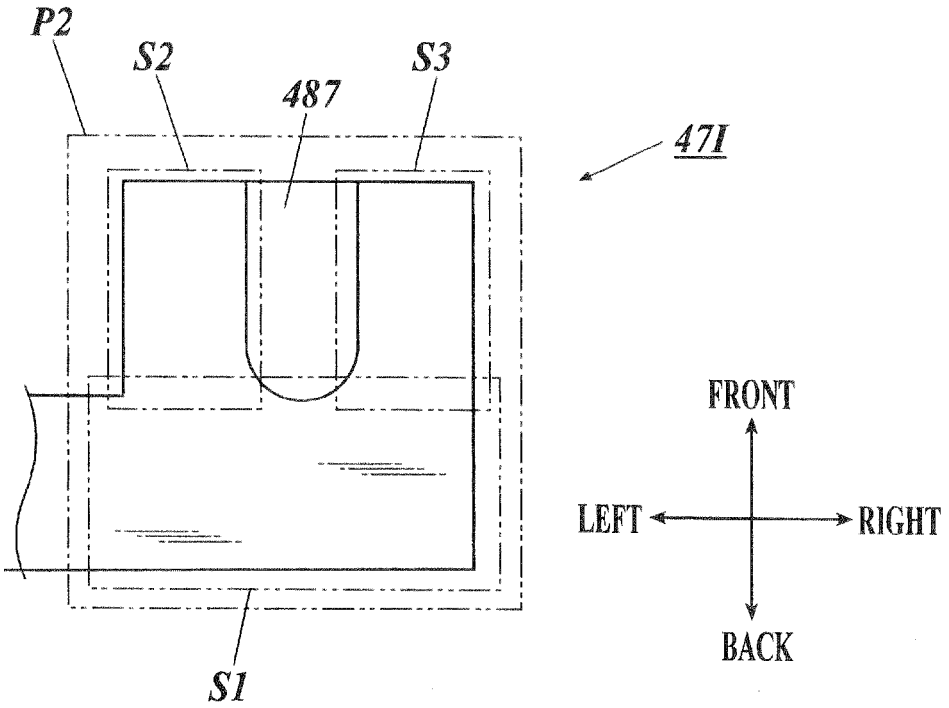
FIG. 14B is an explanatory diagram showing the soldering surface of the plate-like leg of FIG. 14A which is another example of plate-like leg.

On the other hand, as shown in the plate-like leg 471 in FIG. 14A, the orthogonal extending sections S2 and S3 can be formed in the soldering surface as shown in FIG. 14B while the shape of the plate-like leg when seen planarly remains as it is by forming an indentation 487 in a concave shape section in the upper side by strip processing and not cutting out a concave shape section.

The same advantage as in the above described plate-like leg 47 can also be obtained by the plate-like leg 47I having the above configuration.

[Others]

In the above embodiment, a power source connector is exemplified as an electronic component. However, the above described substrate attachment configuration which uses the plate-like legs 47 can be applied to any connector which performs sending and receiving of data and other electronic signals as long as the connector is provided with contact terminals 60 respectively at left and right sides thereof. In such case, the number of connecting terminal 20 is not limited to two and can be more.

Further, the above described substrate attachment configuration is not applied only to connectors, and the substrate attachment configuration which uses the plate-like legs can be applied to other electronic components such as a card reader and a card slot, for example, provided with contact terminals 60 respectively at left and right sides and a metallic shell which forms an insertion opening to inserts some sort of an object.

Furthermore, the left and right contact terminals 60 can be used as terminals for performing sending and receiving data and other electronic signals.

With respect to the back side plate-like legs 46 and the plate-like legs 65 of the contact terminals 60, they do not specifically have durable structures for peel load. However, it is needless to say that the structure similar to that of the front side plate-like legs 47 can be provided for the plate-like legs 46 and 65.

Only two plate-like legs, in front and back sides, are provided at each of the side surface sections 42 of the metallic shell 40. However, more plate-like legs can be provided in front-back direction. In such case, it is preferred that the durable structure with respect to peel load similar to that in the plate-like legs 47 is carried out at least to the plate-like legs which position in the very front, and further, the durable structure with respect to peel load may also be realized in more of the plate-like legs.

Further, the plate-like legs 46 and 47 are formed integrally with the metallic shell 40. However, each of the plate-like legs 46 and 47 may be formed as a member different from the metallic shell 40 and may be attached to the side surfaces of the metallic shell 40 afterwards by performing wielding, attaching or the like.

Moreover, each of the plate-like legs 65 is formed of a member different from the metallic shell 40. However, the plate-like legs 65 and the metallic shell 40 may be formed integrally from one member by partially cutting out, bending and rolling one metallic plate. In such case, the contact terminal holding units 66 can be omitted.

According to a first aspect of the present invention, an electronic component includes a terminal holding unit which holds a plurality of terminals, a metallic shell which houses the terminal holding unit inside thereof, the metallic shell including an insulation opening where a connection object which connects with the terminals is inserted and contact terminals which are adjacent to the metallic shell, each of the contact terminals including a contact plane which faces an insertion direction of the connection object into the metallic shell, and a plate-like leg for fixating the metallic shell to a substrate is formed at each of side surfaces of the metallic shell, the plate-like leg extends outward from each of the side surfaces of the metallic shell, and the plate-like leg includes an extended end section having a soldering surface shape including a base section that extends along an extending direction, an orthogonal extending section that extends from a side edge of the base section along the insertion direction of the insertion opening being orthogonal to the base section.

According to the present invention, the soldering surface of the plate-like legs have a shape including the base section along the extending direction and the orthogonal extending section which extends from the base section in the orthogonal direction. When a stress is applied to the main body side of the metallic shell in the peeling direction by an external terminal contacting the contact planes of the contact terminals by being pressed from the front side, the stress is transmitted to the plate-like legs along the side edges, that is, along the extending direction.

In such case, if the soldering surface is formed in a straight line along the side ends of the plate-like legs, the peel stress can transmit easily and the peeling cannot be prevented sufficiently when the stress to the main body side of the metallic shell becomes large. However, because the soldering surfaces at the extended end sections have a shape including an orthogonal extending section which extends from the base section in the direction orthogonal to the base section, the peel stress which transmits along the base section does not transmit easily to the orthogonal extending sections. Therefore, progression of the peeling is to be blocked from proceeding further from the orthogonal extending sections and the peeling is effectively blocked. Thus, the peel strength can be enhanced.

Preferably, the metallic shell is fixated to the substrate by being engaged to a notch in the substrate, the notch being formed according to an outer shape of the metallic shell.

According to the present invention, a so-called mid-mount method where the metallic shell is fixated to the substrate by being engaged to the notch in the substrate, the notch being formed according to the external shape of the metallic shell is adopted. In such method, the substrate can be thinned when an electronic component is mounted.

On the other hand, there is a problem that the substrate is apt to receive a load in vertical direction in the mid-mound method. However, in such case, a great durability to the peel load can be realized and improvement in both thinning of the substrate and durability to peeling of the electronic component can be realized.

Preferably, a plurality of plate-like legs for fixating the metallic shell to the substrate by soldering are formed at each of the side surfaces of the metallic shell along the insertion direction, and among the plurality of plate-like legs, at least a plate-like leg at the most upstream side in the insertion direction has the soldering surface shape including the base section and the orthogonal extending section.

According to the present invention, when a plurality of plate-like legs are formed at each of the side surfaces of the metallic shell along the insertion direction, and at least the plate-like leg at the most upstream side in the insertion direction has an orthogonal extending section in the soldering surface thereof. In such case where a plurality of plate-like legs are included, the upstream side in the insertion direction of the metallic shell is apt to swing by setting the plate-like legs which are at the most downstream side in the insertion direction as the points of support. However even in such case, peel stress in all of the plurality of plate-like legs can be reduced and the durability to peel strength can be improved as a whole by improving the durability to peel strength of the plate-like legs at the most downstream side in the insertion direction.

Preferably, the orthogonal extending section in a soldering surface of the plate-like leg extends from the base section toward an upstream side in the insertion direction of the insertion opening.

According to the present invention, the orthogonal extending sections of the soldering surface of the plate-like legs is in a shape extending toward upstream side in the insertion direction of the insertion opening. Therefore, transmission of peel stress can be blocked even more effectively and durability to peel load can be improved more because orthogonal extending sections are extended in the direction opposite to the transmission direction of the peel stress due to peel load which is generated at the plate-like legs of the metallic shell via the contact terminals by an external terminal contacting the contact terminals.

The embodiments disclosed above are examples in all aspects and the invention is not limited to the embodiments shown. Therefore, the scope of the invention is intended to be limited solely by the scope of the claims and not by the above descriptions, and equivalents to the claims within the meaning and range thereof and all the modifications are to be included.

The entire disclosure of Japanese Application No. 2011-103390 filed on May 6, 2011 including description, claims, drawings, and abstract are incorporated herein by reference in its entirety.

What is claimed is:

1. An electronic component comprising:

a terminal holding unit which holds a plurality of terminals;

a metallic shell which houses the terminal holding unit inside thereof, the metallic shell including an insulation opening where a connection object which connects with the terminals is inserted; and contact terminals which are adjacent to the metallic shell, each of the contact terminals including a contact plane which faces an insertion direction of the connection object into the metallic shell, wherein:

a plate-like leg for fixing the metallic shell to a substrate is formed at each of side surfaces of the metallic shell, the plate-like leg extends outward from each of the side surfaces of the metallic shell, the plate-like leg includes an extended end section having a soldering surface shape including a base section that extends along an extending direction, an orthogonal extending section that extends from a side edge of the base section along the insertion direction of the insertion opening being orthogonal to the base section, and the orthogonal extending section in a soldering surface of the plate-like leg extends from the base section toward an upstream side in the insertion direction of the insertion opening.

2. An electronic component comprising:

a terminal holding unit which holds a plurality of terminals;

a metallic shell which houses the terminal holding unit inside thereof, the metallic shell including an insulation opening where a connection object which connects with the terminals is inserted; and contact terminals which are adjacent to the metallic shell, each of the contact terminals including a contact plane which faces an insertion direction of the connection object into the metallic shell, wherein:

a plate-like leg for fixing the metallic shell to a substrate is formed at each of side surfaces of the metallic shell, the plate-like leg extends outward from each of the side surfaces of the metallic shell, the plate-like leg includes an extended end section having a soldering surface shape including a base section that extends along an extending direction, an orthogonal extending section that extends from a side edge of the base section along the insertion direction of the insertion opening being orthogonal to the base section, the metallic shell is fixed to the substrate by being engaged to a notch in the substrate, the notch being formed according to an outer shape of the metallic shell, and the orthogonal extending section in a soldering surface of the plate-like leg extends from the base section toward an upstream side in the insertion direction of the insertion opening.

3. An electronic component comprising:

a terminal holding unit which holds a plurality of terminals;

a metallic shell which houses the terminal holding unit inside thereof, the metallic shell including an insulation opening where a connection object which connects with the terminals is inserted; and contact terminals which are adjacent to the metallic shell, each of the contact terminals including a contact plane which faces an insertion direction of the connection object into the metallic shell, wherein:

a plate-like leg for fixing the metallic shell to a substrate is formed at each of side surfaces of the metallic shell, the plate-like leg extends outward from each of the side surfaces of the metallic shell, the plate-like leg includes an extended end section having a soldering surface shape including a base section that extends along an extending direction, an orthogonal extending section that extends from a side edge of the base section along the insertion direction of the insertion opening being orthogonal to the base section, a plurality of plate-like legs for fixing the metallic shell to the substrate by soldering are formed at each of the side surfaces of the metallic shell along the insertion direction, among the plurality of plate-like legs, at least a plate-like leg at a most upstream side in the insertion direction has the soldering surface shape including the base section and the orthogonal extending section, and the orthogonal extending section in a soldering surface of the plate-like leg extends from the base section toward an upstream side in the insertion direction of the insertion opening.

4. The electronic component according to claim 3, wherein the metallic shell is fixed to the substrate by being engaged to a notch in the substrate, the notch being formed according to an outer shape of the metallic shell.

* * * * *